United States Patent [19]

Hinson

[11] Patent Number: 4,932,236

[45] Date of Patent: Jun. 12, 1990

[54] VEHICLE REPAIR SUPPORT RACK

[76] Inventor: Virgil H. Hinson, 206 Fairway Oaks Dr., Brunswick, Ga. 31523

[21] Appl. No.: 402,756

[22] Filed: Sep. 5, 1989

[51] Int. Cl.[5] ..... B21D 1/12

[52] U.S. Cl. ..... 72/447; 72/705

[58] Field of Search ..... 72/447, 457, 705

[56] References Cited

U.S. PATENT DOCUMENTS

| | | | |
|---|---|---|---|
| 3,583,203 | 6/1971 | Williams et al. | 72/705 |
| 4,313,335 | 2/1982 | Eck . | |
| 4,370,882 | 2/1983 | Labbe . | |
| 4,398,410 | 8/1983 | McWhortee et al. . | |
| 4,475,716 | 10/1984 | Jarmin et al. . | |
| 4,592,225 | 6/1986 | Eck | 72/705 |
| 4,643,015 | 2/1987 | Larson et al. . | |
| 4,658,274 | 4/1987 | Brewer, Sr. . | |
| 4,700,559 | 10/1987 | Larson et al. . | |
| 4,712,417 | 12/1987 | Jarman et al. . | |
| 4,794,783 | 1/1989 | Eck . | |

*Primary Examiner*—Lowell A. Larson

*Attorney, Agent, or Firm*—Fleit, Jacobson, Cohn, Price, Holman & Stern

[57] ABSTRACT

A vehicle repair support rack is provided for support in elevated position relative to a repair shop floor and includes support structure therefore whereby one end of the ramp may be raised and lowered relative to the floor. Opposite longitudinal side portions of the rack and the aforementioned one end thereof include peripheral track structure extending thereabout and at least one carriage is mounted for the track structure for movement therealong and projects considerably horizontally outwardly of the periphery of the rack. A portable, wheeled pull tower for use in conjunction with a repair shop floor anchored track is provided and is loadable onto the rack by the carriage (which includes an upper platform surface) when the one end of the rack is lowered and the carriage is supported therefrom to enable the platform thereof to define a loading ramp for the pull tower. The carriage includes the equivalent of floor a anchored track with which the base the pull tower may be removably anchored, the carriage is releasably lockable in selected positions along the track and the upper tower portion of the pull tower supporting the pull developing force structure is mounted from the lower portion of the pull tower for angular displacement relative thereto about an vertical axis and includes outwardly and downwardly inclined brace structure equipped with a footed lower end for abutting engagement with the platform of the carriage to resist deflection of the pull tower in a direction opposite to the pull force exerted thereabout.

12 Claims, 4 Drawing Sheets

VEHICLE REPAIR SUPPORT RACK

BACKGROUND OF THE INVENTION

1. Field of the Invention

This invention relates to a rack up on to which a vehicle may be moved and from which the vehicle may be stationarily supported for frame, sub-frame and body panel straightening and aligning purposes. The rack defines an outer periphery within the boundaries of which an associated vehicle upon which straightening and aligning work is to be performed may be supported and the outer periphery of the frame includes work platforms supported therefrom for guided movement thereabout and from which swivel pull towers may be removably supported, which pull towers are to be basically constructed in the manner disclosed in U.S. Pat. No. 4,712,417, but modified to include an upper tower portion angularly displacable about a vertical axis relative to the base of the tower.

2. Description of Related Art

Various different forms of support racks including some of the general structural and operational features of the instant invention are disclosed in U.S. Pat. Nos. 4,313,335, 4,370,882, 4,398,410, 4,643,015, 4,700,559 and 4,794,783. In addition, pull towers are not only disclosed in the above mentioned U.S. Pat. No. 4,712,417 but also in U.S. Pat. Nos. 4,475,716 and 4,658,627. However, these previously known devices do not include structure whereby pulls angulated about a vertical axis as well as angulated about a horizontal may be applied to repair rack supported vehicles through the utilization of portable pull towers.

SUMMARY OF THE INVENTION

The vehicle repair support rack of the instant invention has been designed to facilitate the application of frame, sub-frame and/or body panel pulls on a vehicle being repaired. The support rack incorporates features which facilitate the application of such repair pulls throughout the entire repair process, including the loading of a vehicle on the repair rack, elevation of the vehicle relative to the rack, stationery anchoring of the vehicle in an elevated position relative to the rack and the placement of one or more pull towers about the vehicle on the repair rack as well as adjustment of the pull tower or towers relative to the vehicle in order to exert angle pulls thereon, if desired.

In addition, the rack is designed to use conventional pull towers of the portable type which also may be used in conjunction with floor anchored tracks independent of the repair rack to thereby greatly reduce the cost of a repair rack to a vehicle repair facility having floor anchored tracks and portable pull towers for use in conjunction therewith.

The main object of this is to provide a vehicle repair rack upon which a vehicle to be repaired may be loaded, elevated relative to the rack, stationerily anchored in elevated position relative to the rack and have various angle pulls exerted thereon through the utilization of modified portable pull towers.

Another object of this invention is to provide a vehicle repair rack which is specifically designed to use portable pull towers of the type originally designed for use in conjunction with floor anchored tracks.

Another very important object of this invention is to provide a repair rack with which body component alignment gages may be readily used.

Yet another object of this invention is to provide a repair rack constructed in a manner whereby one or more floor supported portable pull towers may be readily loaded upon an unloaded from the repair rack.

A final object of this invention to be specifically enumerated herein is to provide a repair rack in accordance with the preceding objects and which will conform to conventional forms of manufacture, be of simple construction and easy to use so as to provide a device that will be economically feasible, long-lasting and relatively trouble free in operation.

These together with other objects and advantages which will become subsequently apparent reside in the details of construction and operation as more fully hereinafter describe and claimed, reference being had to the accompanying drawings forming a part hereof, wherein like numerals refer to like parts throughout.

BRIEF DESCRIPTION OF THE DRAWINGS

FIG. 11 is a side elevational view of the rack in the process of having a vehicle to be repaired loaded thereon to;

DESCRIPTION OF THE PREFERRED EMBODIMENT

Figure 1:
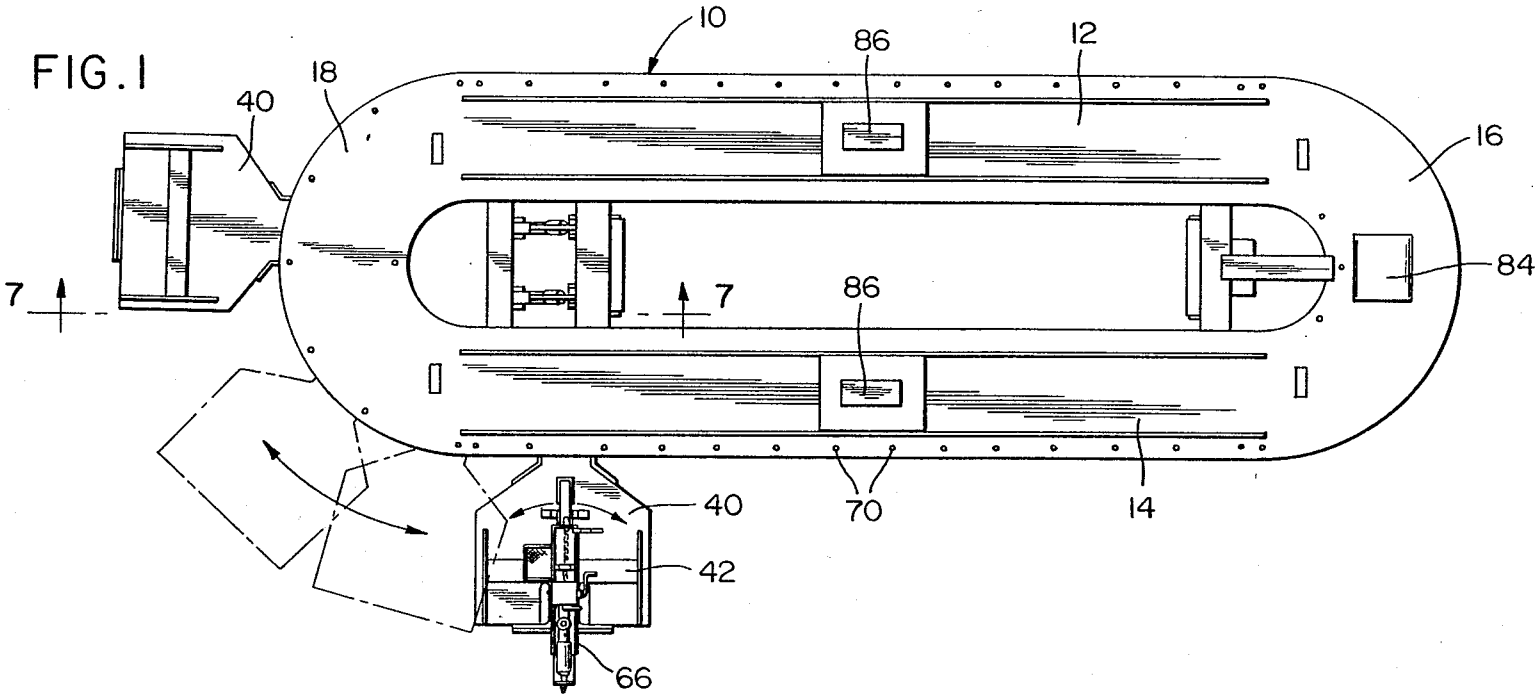
FIG. 1 is a top plan view of the repair rack of the instant invention illustrating a pair of pull tower support carriages supported therefrom for movement about the outer periphery of the rack and with one of the carriages positioned at one end of the rack to illustrate the manner in which the platform portion thereof may be used as a ramp for loading a portable pull tower on the corresponding rack end.
Figure 2:
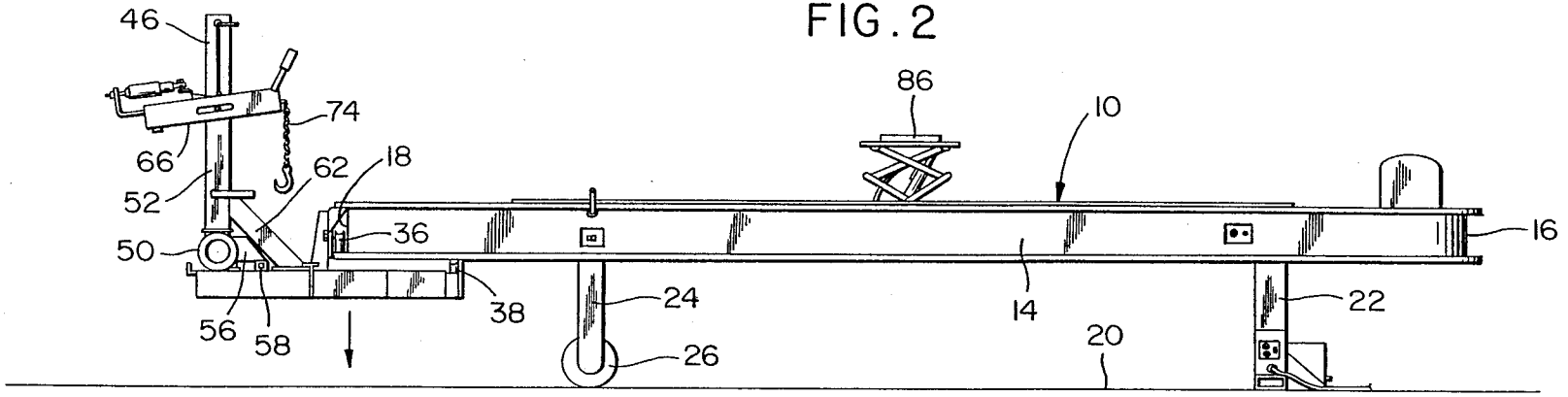
FIG. 2 is a side elevational view of the assemblage illustrated in FIG. 1.
Figure 3:
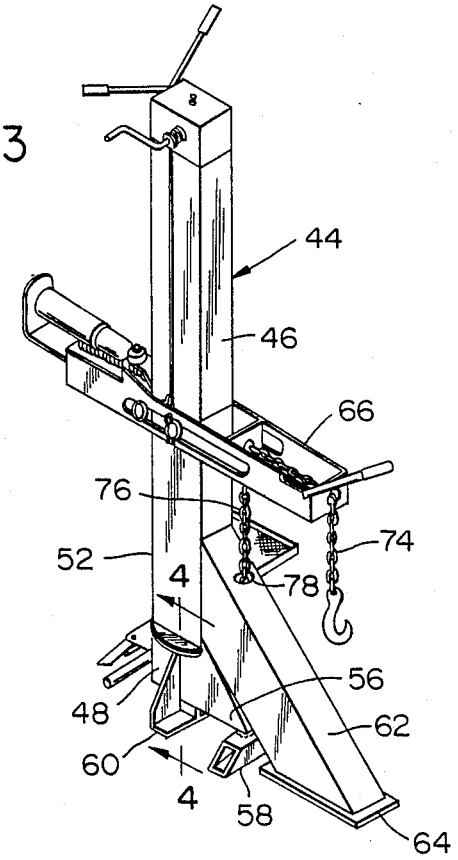
FIG. 3 is a perspective view of a portable pull tower specially designed for use in conjunction with the support rack, the near side support wheel of the pull tower being removed.
Figure 7:
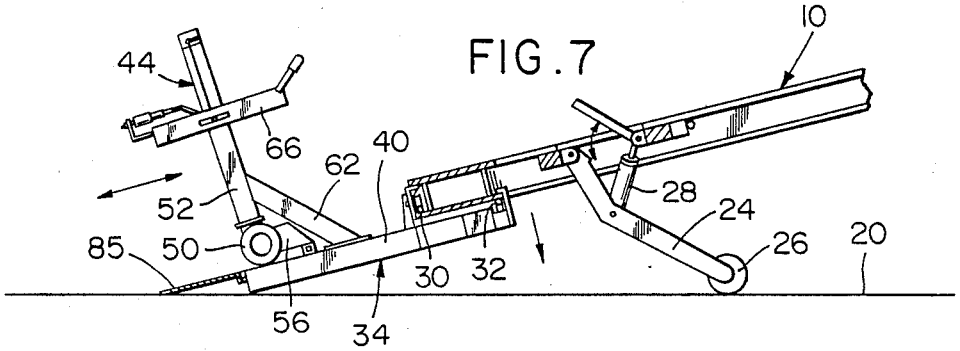
FIG. 7 is a fragmentary enlarge vertical sectional view taken substantially upon the plane indicated by the section line 7—7 of FIG. 1 and with the corresponding end of the rack in a lowered position and a portable pull tower positioned on one of the carriages for loading onto and unloading from the corresponding ramp end.

Referring now more specifically to the drawings the numeral 10 generally designates the vehicle repair support rack of the instant invention. The rack 10 comprises a structure which is ovate in plan shape including a pair of longitudinally straight opposite side portions 12 and 14 whose corresponding ends are interconnected by front and rear semicircular portions 16 and 18. The rack 10 is supported in elevated position from suitable flooring 20 by a pair of depending front legs 22 from whose upper ends the forward end of the rack 10 is mounted for oscillation about a horizontal transverse axis and a pair of rear legs 24 between whose lower ends a flooring engagable roller 26 is journaled and whose upper ends are swingably supported from the rear half of the rack 10, suitable fluid cylinders 28 being operatively connected between the rear half of the rack 10 and the legs 24 whereby the rear end of the rack 10 may be raised and lowered relative to the flooring 20, compare FIGS. 2 and 7.

The rack 10 includes an upper outer tubular rail 30 extending thereabout as well as a lower inner tubular 32 extending thereabout. The rails 30 and 32 define a peripheral guide track and one or more carriages referred to in general are provided and include outer and inner grooved guide wheels 36 and 38 rollingly engaged with the rails 30 and 32. The carriages 34 are thereby supported from the rack 10 from movement about the outer periphery thereof and each carriage 34 includes a support table 40 supported therefrom and extending outward from the corresponding peripheral portion of the rack 10. Each support table has a transverse anchor rail 42 supported therefrom corresponding to a floor mounted pull tower anchor rail and each support table 40 may support a portable pull tower 44 therefrom constructed, generally, in accordance with the pull tower disclosed in U.S. Pat. No. 4,712,417.

Figure 4:
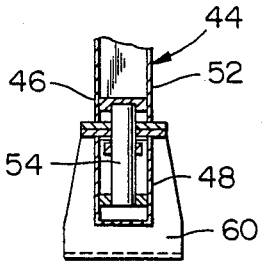
FIG. 4 is a fragmentary enlarged vertical sectional taken substantially upon the plane indicated by the section line 4—4 of FIG. 3.
Figure 5:
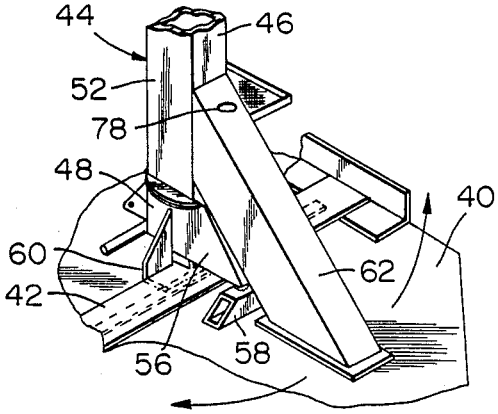
FIG. 5 is a fragmentary perspective view of the lower portion of the support tower illustrated in FIG. 3 and disclosing the manner in which the pull tower is designed to be used in conjunction with a floor mounted track.

The pull tower 44 is substantially identical to the pull tower disclosed in U.S. Pat. No. 4,712,417, but includes a tower member 46 including a base portion 48 from which opposite side support wheels 50 are journaled and an upper portion 52 pivotally supported from the base portion 48 for angular displacement relative thereto about a vertical axis, as at 54, see FIG. 4. The base portion 48 includes a forwardly directed horizontal arm 56 including a support table engaging foot secured under the forward end of the arm 56 and a forwardly opening lower transverse angle member portion 60 engagable behind and beneath the corresponding anchor rail 42. Also, the lower end of the upper portion 52 includes a forwardly and downwardly inclined brace 62 including a downwardly facing foot 64 on its lower end for swinging movement over and engagement with the corresponding support table 40.

The upper portion 52 of the tower member 46 may of course be angularly adjusted about a vertical axis relative to the base portion 48 by the pivot connection defined at 54. In addition, the brace 62 swings relative to the base portion 48 with the upper portion 52 and the foot 64 slides over the support table 40 during such adjustment. In this manner, the pull arm assembly 66 of the pull tower 44 may be angularly adjusted about the vertical axis defined by the pivot connection 54 relative to the base portion 48.

Figure 6:
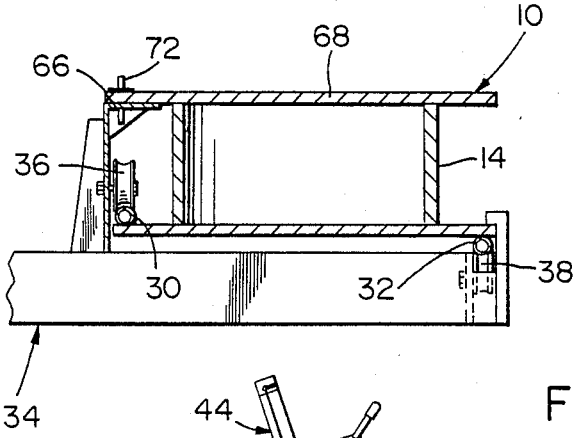
FIG. 6 is a fragmentary enlarged vertical sectional view illustrating the manner in which one of the carriages is mounted from the periphery of the support rack for movement thereabout.

Each of the carriages 34 includes an apertured upper horizontal flange portion 66, see FIG. 6, disposed beneath the upper plate 68 of the rack 10 and each opposite side portion 12 and 14 as well as at least the end portion 18 of the rack 1 includes peripherally spaced apertures 70 formed in the upper plate 68 thereof with which the aperture in one of the flange portions 66 may be registered and lock pins 72 are removably downwardly engagable through selected apertures 70 and a corresponding apertured upper horizontal flange portion registered therewith to thereby lock the associated carriages in selected positions about the periphery of the rack 10.

Each of the portable pull towers 44 includes a pull chain 74 operatively associated therewith and the unused end portion 76 of each pull chain 74 may be downwardly received through an aperture 78 formed in the corresponding brace 62.

Figure 11:
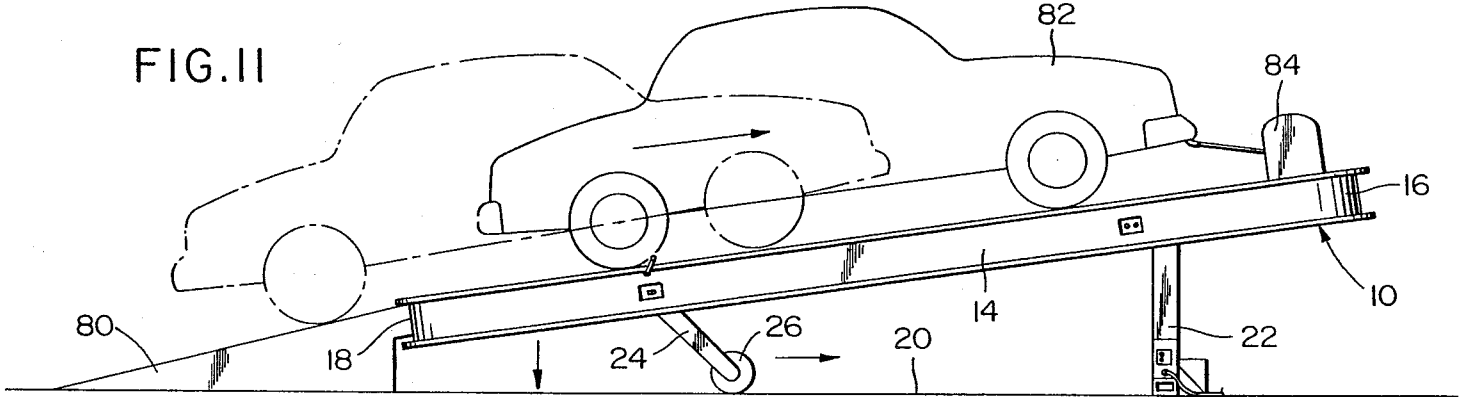

As shown in FIG. 11, the rear end of the rack 10 may be lowered toward the flooring 20 and a ramp structure 80 may be used when a vehicle 82 is being loaded onto or unloaded from the ramp 10, the forward end of the ramp 10 being provided with a winch assembly 84 for use in pulling the vehicle 82 up onto the ramp 10 over the ramp structure 80. In addition, when the ramp 10 has its rear end lowered toward the flooring 20 in the manner illustrated in FIG. 11 and ramp structure 80 is removed, a carriage 34 may shifted to the rear end of the ramp 10 and utilized, in conjunction with a smaller ramp structure 85 for the purpose of loading a portable pull tower 44 onto the rack 10 via the carriage 34 from which the pull tower 44 ultimately will be supported.

Still further, each of the opposite side portions 12 and 14 of the rack 10 includes a hydraulic cylinder actuated scissors-type jack 86 supported therefrom whereby the vehicle 82 loaded upon the rack 10 may be elevated relative thereto. Also, each opposite side portion and 12 and 14 of the rack 10 includes a pair of pinch weld clamp assemblies referred to in general by the reference numerals 88 guidingly supported therefrom for adjustable positioning therealong. The pinch weld clamp assemblies each include an outer side guiding and retaining flange 90 for releasable clamped engagement with the outer marginal portion of the upper plate 68 through the utilization of threaded fasteners. In this manner, the pinch weld clamp assemblies 88 may be releasably anchored in adjusted positions along each of the opposite side portions 12 and 14 of the rack 10.

Each of the pinch weld clamp assemblies 88 includes a pair of pinch weld clamps 94 and 96 which are vertically adjustable relative to the remainder of the associated clamp assembly 88 and each pinch weld clamp is basically similar to the pinch weld clamp disclosed in U.S. Pat. No. 4,718,266 and is therefore capable of supporting the associated vehicle 82.

Figure 8:
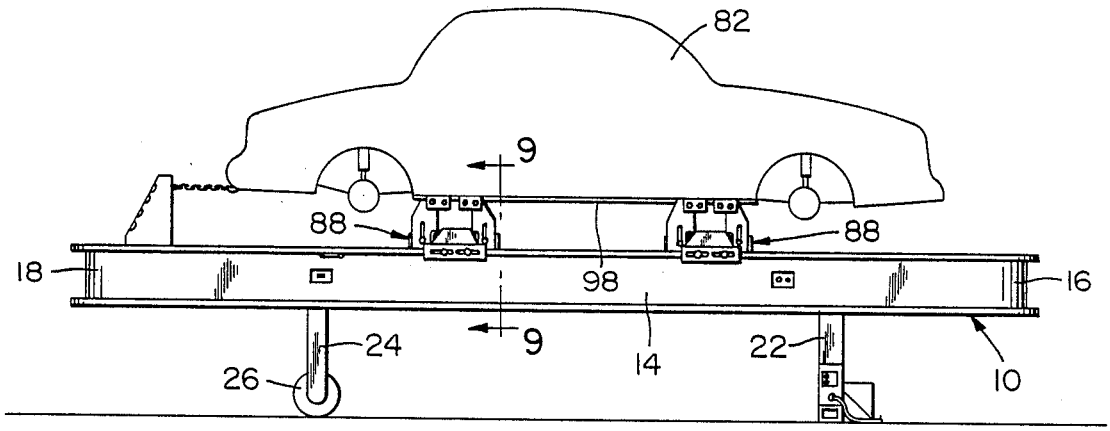
FIG. 8 is a side elevational of the rack in an elevated position and with a vehicle stationarily anchored in elevated position relative to the rack through the utilization of rack supported pinch weld clamps.
Figure 9:
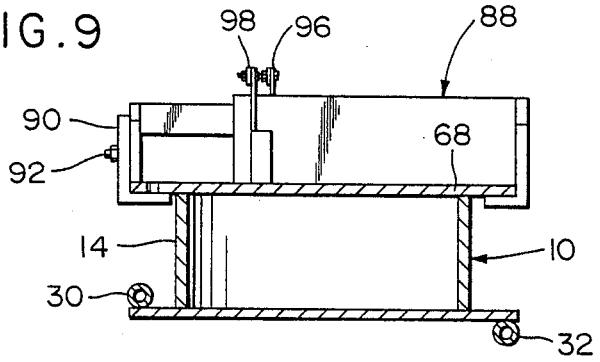
FIG. 9 is an enlarged fragmentary vertical sectional view taken substantially upon the plane indicated by the section line 9—9 of FIG. 8.
Figure 10:
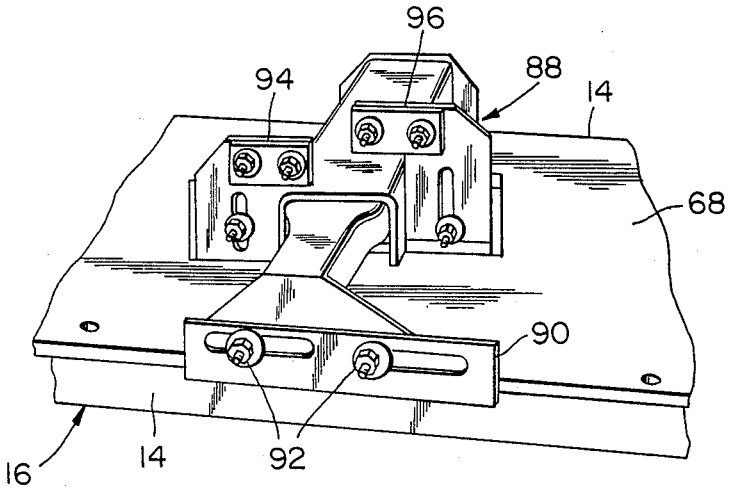
FIG. 10 is an enlarged fragmentary perspective view illustrating one marginal portion of the rack and a typical pinch weld clamp supported therefrom.

In operation, the vehicle 82 may be loaded onto the rack 10 through utilization of the winch assembly 84 in the manner illustrated FIG. 11. After the vehicle 82 has been loaded, one or more pull towers 44 may be also loaded upon the rack 10 through the utilization of corresponding carriages 34 in the manner illustrated in FIG. 7. Thereafter, the jacks 86 may be utilized to elevate the vehicle 82 to the position thereof illustrated in FIG. 8 and the pinch weld clamp assemblies 88 may be properly positioned and clamped in position through the utilization the threaded fasteners 92 subsequent to the engagement of the pinch weld clamps 94 and 96 with the pinch weld area 98 of the vehicle 82 in the manner illustrated in FIG. 8. Thereafter, the pull chains 74 of a plurality of pull towers 44 may be engaged with selected portions of the vehicle 82 in order to exert straightening pulls thereon. As herein before set forth, the upper portions 52 of the tower members 46 may be angularly adjusted, as desired and the inclined braces 62 of the pull towers 44 are automatically positioned with respect to the direction of the pulls to be exerted by the chains 74 in order to brace the towers 44 against the pulls exerted thereby, the pull towers 44 being previously positioned as desired by shifting of the carriages 34 to the desired positions thereof and the locking of the carriages 34 in the selected positions thereof through utilization of the lock pins 72.

Figure 12:
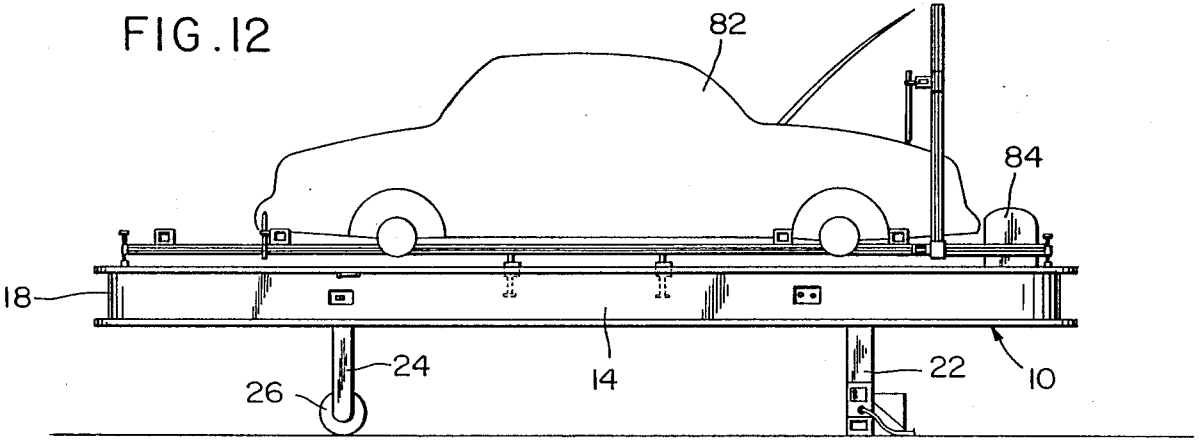
FIG. 12 is side elevational view of the rack with gauge structure operatively associated therewith for use in gauging the relative positions of various vehicle components.

As may be seen in FIG. 12, a body component gauge system 100 may be supported from the rack 10 and utilized to check the relative positions of various selected areas of the vehicle 82.

The foregoing is considered as illustrative only of the principles of the invention. Further, since numerous modifications and changes will readily occur to those skilled in art, it is not desired to limit the invention to the exact construction and operation as shown and described and, accordingly, all suitable modifications and equivalents may be resorted to, falling within the scope of the invention.

What is claimed as new is as follows:

1. A vehicle repair support rack including anchor means for stationarily supporting vehicle frame means thereon and defining an outer peripheral portion including two opposite longitudinal side portions and at least one transverse end portion extending between and interconnecting corresponding ends of said longitudinal side portions, said outer peripheral portion defining track structure extending thereabout, at least one carriage guidingly engaged with said track structure for support therefrom and adjustment therealong, said carriage and said track structure including coacting lock means operative to releasably lock said carriage in selected adjusted positions along said track structure, said carriage including a support table disposed outward of said track structure and outer peripheral portion, a portable pull tower incorporating wheeled base means stationarily removably mounted from said support table and including an upstanding tower member mounted from said base means for angular displacement relative thereto about an upstanding axis, said base means and table including readily removably engagable anchor structure preventing movement of said base means relative to said table toward the adjacent outer peripheral portion of said support rack, an elongated generally horizontal pull arm mounted from said tower member for guided adjustable shifting therealong and angular displacement relative to said tower member about an horizontal axis disposed transverse to said pull arm, said pull arm including means operative to apply a pull on an associated tension member in a direction extending longitudinally of said arm, said tower member including brace means extending outward and downward from the side of a lower portion of said tower member facing in a direction opposite to the first mentioned direction and including downward facing abutment surface means closely overlying said support table for engagement therewith to brace said tower member against deflection as a result of said pull and swingable back and forth over said support table responsive to adjustable angular positioning of said tower member relative to said base means about said upstanding axis, whereby said tower member will be braced against said pull independent of the adjusted angular positioning of said tower member relative to said base means about said upstanding axis.

2. The vehicle repair support rack of claim 1 wherein said base means includes a horizontally outwardly projecting arm extending from said base means toward the adjacent portion of said outer peripheral portion of said support rack and equipped with downward facing abutment means closely overlying and abuttingly engagable with said support table.

3. The vehicle repair support rack of claim 1 wherein each of said longitudinal side portions includes upwardly extendible and downwardly retractable lift jack means.

4. The vehicle repair support rack of claim 3 including a pair of pinch weld clamp assemblies mounted from each of said longitudinal side portions and adjustably shiftable therealong, each of said pinch weld clamp assemblies being adapted to clampingly engage a corresponding vehicle side body pinch weld area therein for support of the vehicle body in elevated position relative to said support rack.

5. The vehicle repair support rack of claim 1 including front and rear end support means for said rack operable to support said support rack in elevated position above a flooring structure and said support means and rack include means operative to lower and raise said one transverse end portion toward and away from said flooring, said carriage, when supported from said one transverse end portion, being positioned from the support table thereof to define a ramp for loading and unloading said portable pull tower onto and from said support rack.

6. The vehicle repair support rack of claim 1 including a vehicle ramp positionable adjacent and outward of said one transverse end portion when the latter is lowered toward said floor structure to define a loading ramp by which a vehicle may be loaded onto said support rack over said one transverse end portion thereof.

7. A vehicle repair support rack including anchor means for stationarily supporting vehicle frame means thereon and defining an outer peripheral portion including at least two opposite longitudinal side portions and one transverse end portion extending between and interconnecting corresponding ends of said longitudinal side portions, said outer peripheral portion defining a track structure extending thereabout, at least one carriage guidingly engaged with and supported from said track structure for adjusted movement therealong, said carriage and said track structure including coacting lock means operative to releasably lock said carriage in selected adjusted positions along said track structure, said carriage including a support table disposed outward of said track structure, a portable, wheeled pull tower incorporating base means stationarily removably mounted from said support table and an upstanding tower member supported from said base means, an elongated pull arm mounted from said tower member for guided adjustable shifting therealong and angular displacement relative to said tower member about an horizontal axis disposed transversed to said pull arm, said pull arm including means operative to apply a pull on an associated tension member in a direction extending longitudinally of said arm, said tower member including brace means extending outward and downward from the side thereof facing in a horizontal direction opposite to the first mentioned direction and including downward facing abutment surface means closely overlying said support table for engagement therewith to brace said tower member against deflection as a result of said pull, said support table of said carriage, when the latter is adjustably positioned for support from said one transverse end portion of said rack and said one transverse end portion is lowered toward said flooring, comprising a loading ramp for loading said portable, wheeled pull tower onto said rack.

8. The vehicle repair support rack of claim 7 wherein each of said longitudinal side portions includes upwardly extendible and downwardly retractable lift jack means.

9. The vehicle repair support rack of claim 8 including a pair of pinch weld clamp assemblies mounted from each of said longitudinal side portions and adjustably shiftable therealong, each of said pinch weld clamp assemblies being adapted to clampingly engage a corresponding vehicle side body pinch weld area therein for support of the vehicle body in elevated position relative to said support rack.

10. The vehicle repair support rack of claim 7 wherein said base means and table include coacting readily removably engagable anchor structure for anchoring said base means relative to said table against movement relative thereto toward the adjacent portion of said outer peripheral portion.

11. A portable, wheeled pull tower including wheeled base means, an upstanding tower member mounted from said base means for angular displacement relative thereto about an upstanding axis, an elongated horizontal pull arm mounted from said tower member for guided adjustable shifting therealong and angular displacement relative to said tower member about a horizontal axis disposed transverse to said pull arm, said pull arm including means operative to apply a pull on an associated tension member in a direction extending longitudinally of said arm, said tower base means including a horizontally outwardly projecting arm extending outward from the side of said base means facing in a direction opposite to the first mentioned direction, the outer end of said arm including downwardly facing abutment means for abutting engagement with a horizontal surface upon which said base means is disposed, said tower member including downwardly and outwardly inclined brace means extending outward and downward from said tower member from the side of said tower member facing in a horizontal direction opposite the first mentioned direction and including downwardly facing abutment means for closely overlying and engagement with a horizontal surface upon which said pull tower is supported to brace said tower member against deflection as a result of said pull and adjustably swingable back and forth over said horizontal surface responsive to adjustable angular displacement of said tower member relative to said base means about said upstanding axis, whereby said tower member will be braced against said pull independent of the bracing of said base means against said pull.

12. The pull tower of claim 11 wherein said base means includes first anchor structure for releasable engagement with coacting second anchor structure mounted from said horizontal surface to prevent movement of said base means relative to said horizontal surface in a direction opposite to said first mentioned direction.

* * * * *